US012679602B2

(12) United States Patent
Ke

(10) Patent No.: US 12,679,602 B2
(45) Date of Patent: Jul. 14, 2026

(54) HOLLOW HAND-HELD STORAGE DEVICE FOR STORING ITEMS

(71) Applicant: HOYI FOOD CO., LTD., Hemei Township (TW)

(72) Inventor: Deng-Yao Ke, Hemei Township (TW)

(73) Assignee: HOYI FOOD CO., LTD., Hemei Township (TW)

( * ) Notice: Subject to any disclaimer, the term of this patent is extended or adjusted under 35 U.S.C. 154(b) by 162 days.

(21) Appl. No.: 18/612,654

(22) Filed: Mar. 21, 2024

(65) Prior Publication Data

US 2025/0296742 A1 Sep. 25, 2025

(51) Int. Cl.
*B65D 35/14* (2006.01)
*B65D 35/44* (2006.01)

(52) U.S. Cl.
CPC ..... *B65D 35/14* (2013.01); *B65D 35/44* (2013.01)

(58) Field of Classification Search
CPC ..... B65D 35/14; B65D 35/44; B65D 35/10; B65D 3/06; B65D 43/0212; B65D 2543/00509; B65D 2543/00638; B65D 2543/00092
See application file for complete search history.

(56) References Cited

U.S. PATENT DOCUMENTS

| | | | | |
|---|---|---|---|---|
| 1,053,272 | A * | 2/1913 | Brady | B65D 3/28 229/402 |
| 2,224,129 | A * | 12/1940 | Amberg | B65D 3/06 493/155 |
| 2,316,150 | A * | 4/1943 | Amberg | B65D 3/06 220/737 |
| 2,805,808 | A * | 9/1957 | Brewer | B65D 3/06 229/400 |
| 10,875,699 | B2 * | 12/2020 | Shih | B65D 3/22 |
| 10,899,494 | B2 * | 1/2021 | Suokas | B65D 5/563 |
| 2013/0001288 | A1 * | 1/2013 | Lin | B65D 25/325 220/763 |
| 2018/0214230 | A1 * | 8/2018 | Jacobs | A61B 90/70 |
| 2020/0262615 | A1 * | 8/2020 | Goddard | B31C 5/00 |
| 2024/0367867 | A1 * | 11/2024 | Fritz | B65D 3/06 |

* cited by examiner

*Primary Examiner* — Vishal Pancholi
(74) *Attorney, Agent, or Firm* — Guice Patents PLLC

(57) ABSTRACT

The present invention provides a hollow hand-held storage device for storing items, comprising a hollow body formed by wrapping a sheet to form a cylindrical body having a chamber, a first end being an opening located at one end of the hollow body and communicating with the chamber, and a second end being a closed end located at the other end of the hollow body. The sheet has different thicknesses which cause different degrees of concavity or deformation on the two side surfaces of the hollow body when subjected to a gripping force. When a user grips the hollow body with one hand, the user can naturally squeeze the hollow body from its bottom to its top by feeling the different degrees of concavity or deformation through a thumb and index finger, thereby squeezing out the item and exposing the item at the first end.

10 Claims, 9 Drawing Sheets

HOLLOW HAND-HELD STORAGE DEVICE FOR STORING ITEMS

FIELD OF INVENTION

The present invention relates to a storage device, in particular to a hollow hand-held storage device for storing items.

BACKGROUND OF THE INVENTION

Conventionally, a method for storing and containing an item such as sauces, creams, spice powders or liquids is generally to form a quadrilateral interior space by peripherally sealing two sheets of soft materials such as paper, plastic film or aluminum foil and storing the item in this interior space. When the stored item is a liquid or semi-solid, and when a user squeezes the quadrilateral body to retrieve the item, the squeezing gripping force applied to the flat soft quadrilateral body is dispersed or absorbed, making it difficult to completely retrieve the item and leaving some residue of the item inside and at the opening of the quadrilateral body.

Another commonly used storage device is a hollow conical body made of paper with an opening, where the opening may be further heat-sealed with an aluminum foil lid and/or the inner layer may be coated with a PE film for further isolating outside air. However, the density of the paper material still leaves room for improvement in terms of freshness preservation or storage effects. When the user squeezes the hollow conical body made of paper to retrieve the contents, since the paper material does not easily return to its original shape after deformation, the liquid or semi-solid contents are still unexpectedly left at the opening.

SUMMARY OF THE INVENTION

A primary purpose of the present invention is to provide a hollow hand-held storage device for storing items that has a better expected effect in use.

A secondary purpose of the present invention is to provide the hollow hand-held storage device for storing items that can provide better freshness preservation or storage effects.

To accomplish the foregoing purposes, the present invention provides the hollow hand-held storage device for storing items, comprising a hollow body formed by wrapping a sheet to form a cylindrical body having a chamber, a first end being an opening located at one end of the hollow body and communicating with the chamber, and a second end being a closed end located at the other end of the hollow body. The sheet has different thicknesses which cause different degrees of concavity or deformation on the two side surfaces of the hollow body when subjected to a gripping force. When a user grips the hollow body with one hand, the user can naturally squeeze the hollow body from its bottom to its top by feeling the different degrees of concavity or deformation through a thumb and index finger, thereby squeezing out the item and exposing the item at the first end.

Some preferred embodiments of the present invention will be described in detail below with reference to the accompanying drawings.

DETAILED DESCRIPTION OF THE PREFERRED EMBODIMENTS

Figure 1:
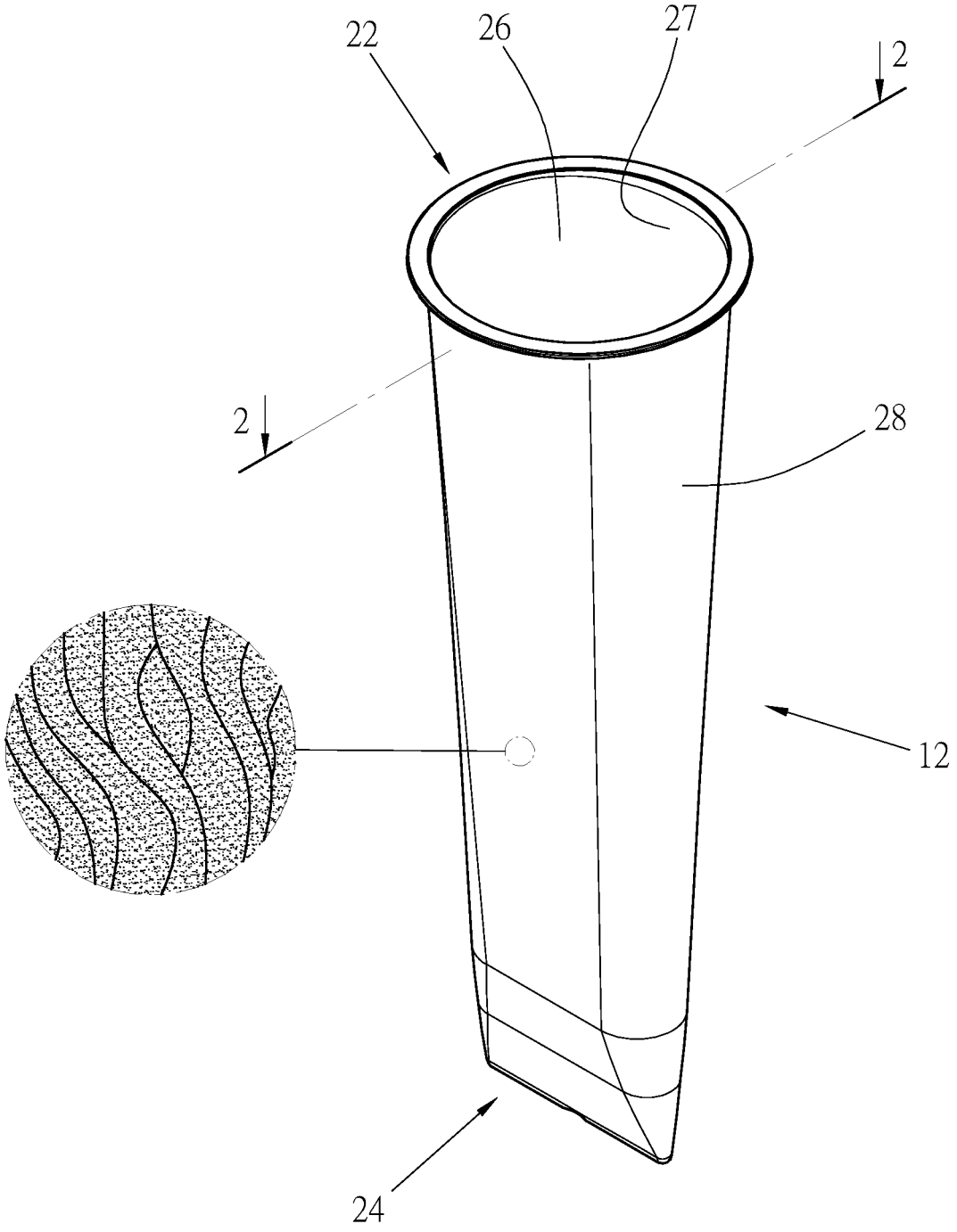
FIG. 1 is a schematic perspective view of a preferred embodiment (1) of the present invention.

Referring to FIGS. 1 to 5, the hollow hand-held storage device for storing items of the present invention includes at least a hollow body 12, a first end 22, and a second end 24.

The hollow body 12 is formed by wrapping a sheet to form like a cylindrical body having a chamber 26, an inner wall surface 27, and an outer wall surface 28. A cross-sectional shape of the hollow body 12 in the transverse direction can be designed to have one end as a circle or a ring, with a cross-sectional area gradually decreasing toward the other end. Wherein a cross-section of a central portion of the hollow body 12 is defined as a central plane.

The first end 22 is an opening located at one end of the hollow body 12 and communicating with the chamber 26, wherein the cross-sectional shape of the first end 22 can be designed to be circular or annular.

The second end 24 is a closed end located at the other end of the hollow body 12, preventing the chamber 26 from communicating with the outside of the hollow body 12 through the second end 24.

Figure 2:
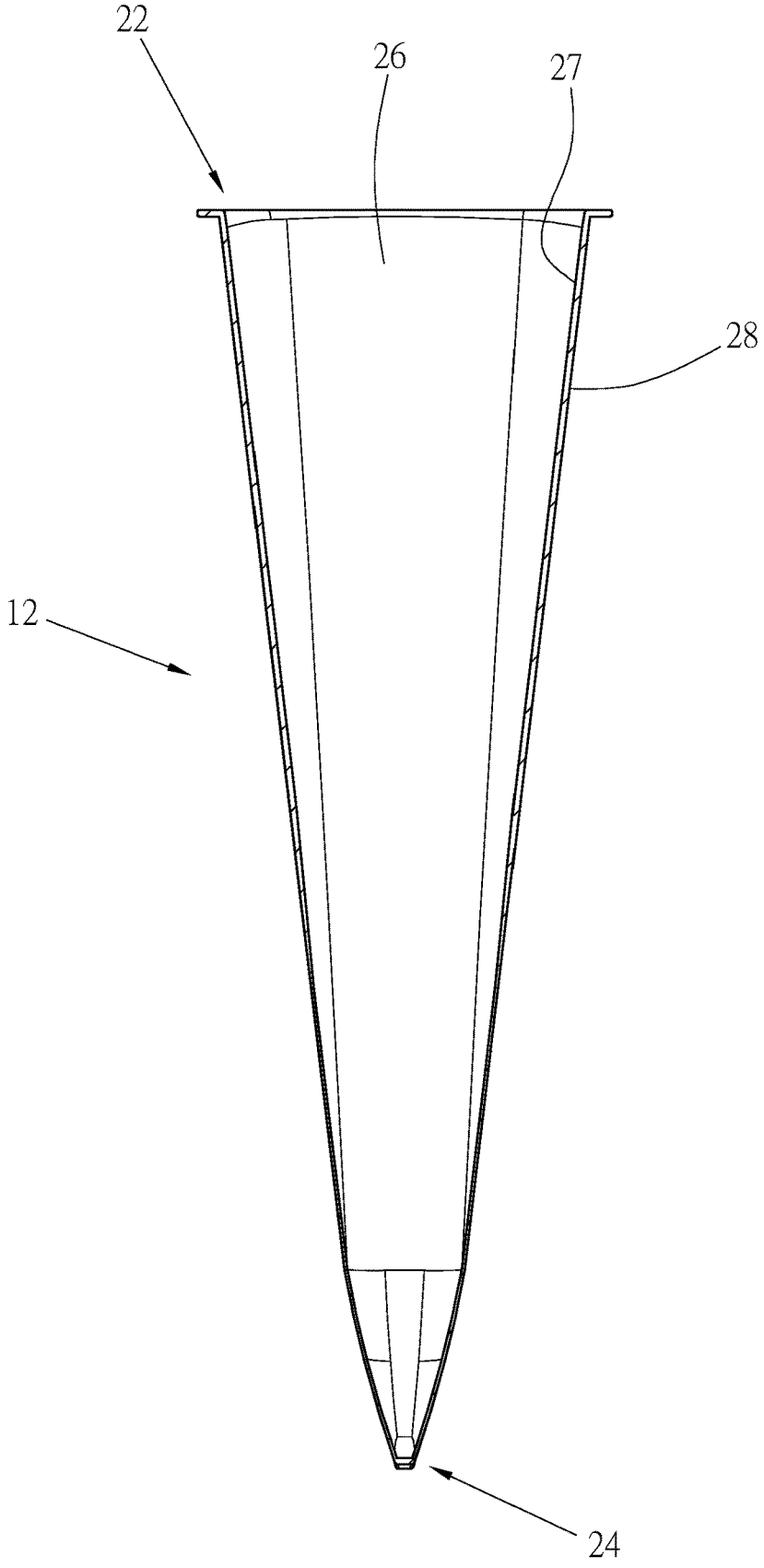
FIG. 2 is a sectional view taken along line 2-2 in FIG. 1.
Figure 3:
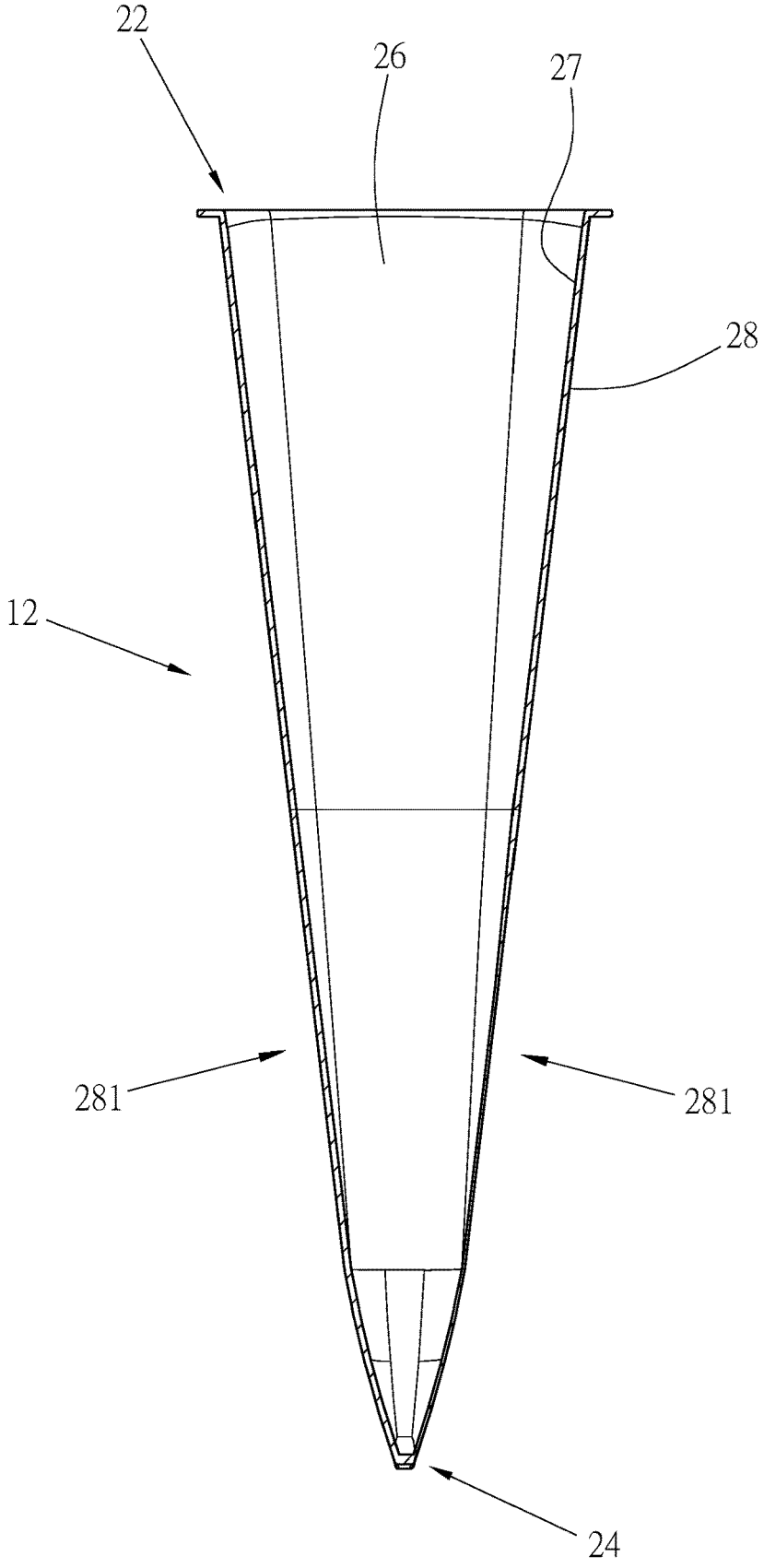
FIG. 3 is a sectional view of a preferred embodiment (2) of the present invention.
Figure 5:
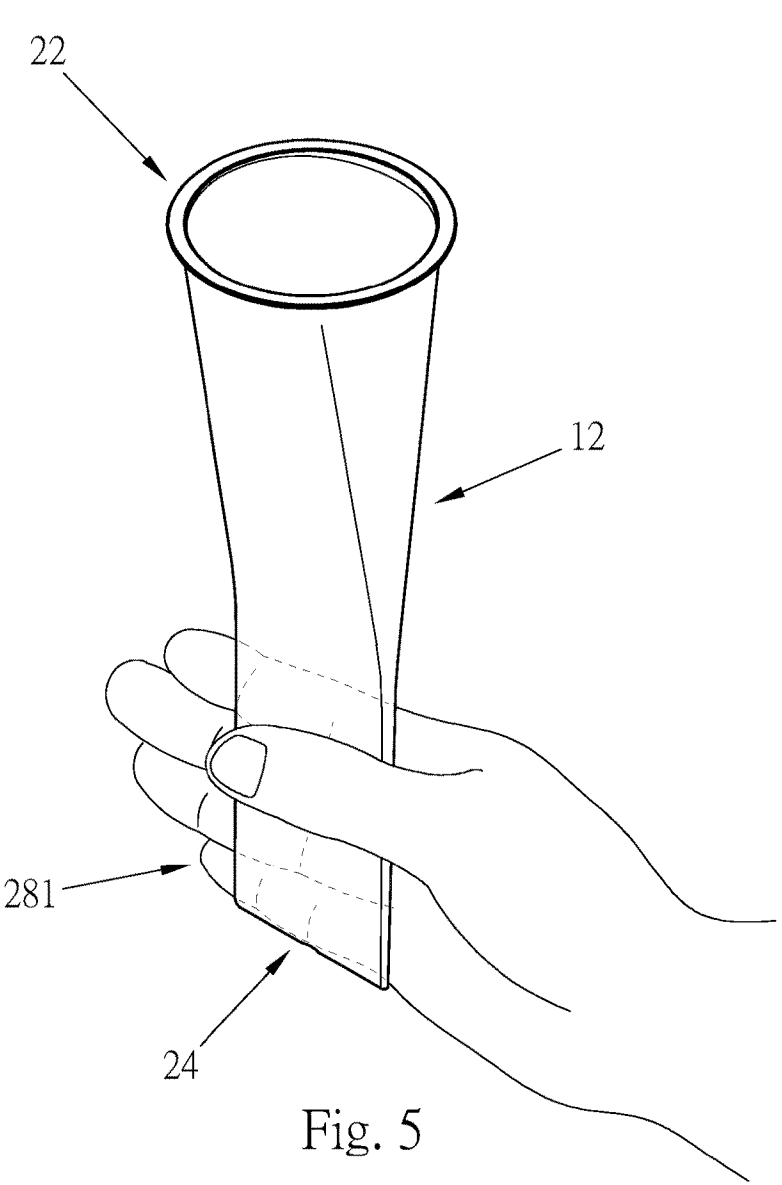
FIG. 5 is a schematic perspective view showing a user using the preferred embodiment (2) of the present invention.
Figure 4:
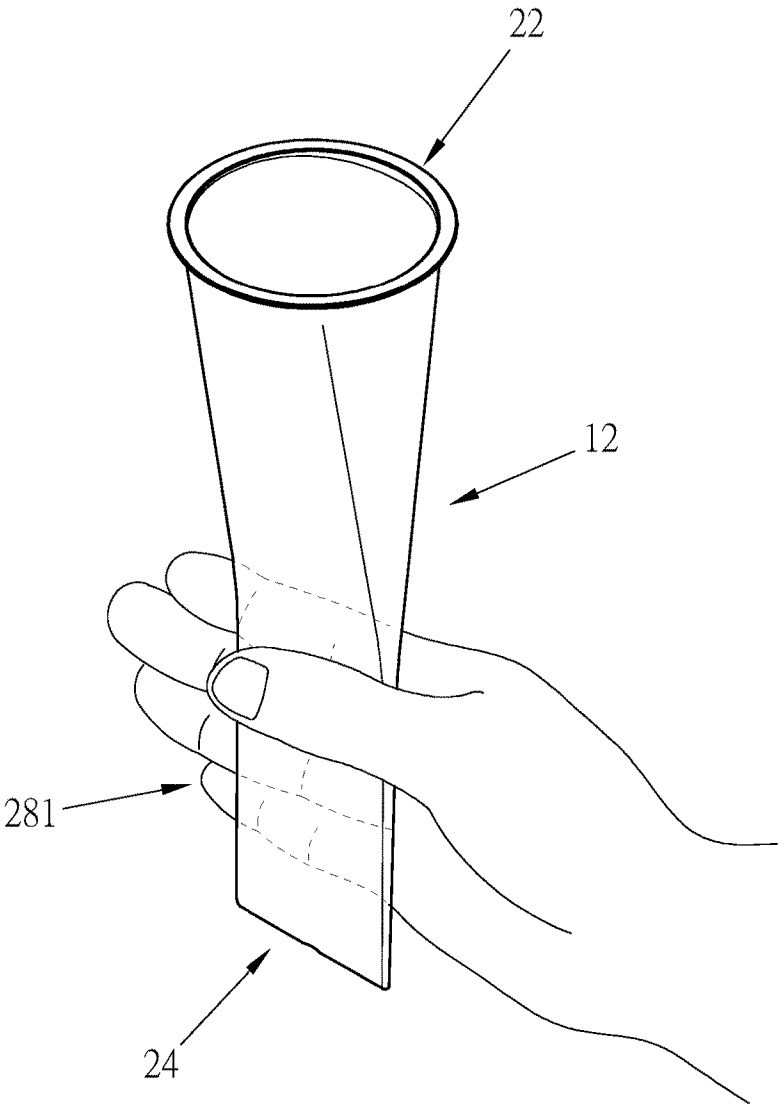
FIG. 4 is a schematic perspective view showing a user using the preferred embodiment (1) of the present invention.

A portion of the hollow body 12 between the first end 22 and the central plane is defined as an upper body, and a portion of the hollow body 12 between the second end 24 and the central plane is defined as a lower body. The sheet has different thicknesses, which can be designed such that the thickness of the sheet in the upper body is greater than the thickness in the lower body (as shown in FIG. 2), or the corresponding two side surfaces 281 of the sheet in the lower body have different thicknesses (as shown in FIG. 3). This is done so that when the central portion or the lower body of the hollow body 12 receives a gripping force (as shown in FIGS. 4 and 5), the degree of concavity or deformation of the hollow body 12 in the lower body is greater than in the upper body, or the two side surfaces 281 of the lower body have different degrees of concavity or deformation. Wherein the gripping force is generated by placing the lower body of the hollow body 12 between a thumb and four fingers of a person and applying a pressing force from the thumb and four fingers (as shown in FIGS. 4 and 5).

In the hollow hand-held storage device for storing items of the present invention, since the central portion or the lower body of the hollow body 12 has different degrees of concavity or deformation when subjected to the gripping force, when storing and containing a semi-solid item such as a gelatin dessert or an ice lolly, a user can grip the corresponding two side surfaces 281 near the second end 24 with one hand and naturally squeeze the hollow body 12 from its bottom to its top by feeling the different degrees of concavity or deformation through the thumb and index finger, thereby squeezing out the item and exposing the item at the first end 22 for consumption or retrieval.

In the hollow hand-held storage device for storing items of the present invention, since the cross-sectional area gradually decreases from the first end 22 toward the second end 24, it is convenient to squeeze the hollow body 12 from its bottom toward its top, thereby squeezing out the item and exposing the item at the first end 22 for consumption or retrieval.

Referring again to FIG. 1, the hollow hand-held storage device for storing items of the present invention is formed by fusion bonding of food-grade plastic pellets such as PP plastic or PE plastic. In other words, it is formed by plastic injection molding having a better density of material structure, so that the present invention has a better effectiveness in isolating external air and provides better freshness preservation and storage effects when applied to containing food items.

Figure 6:
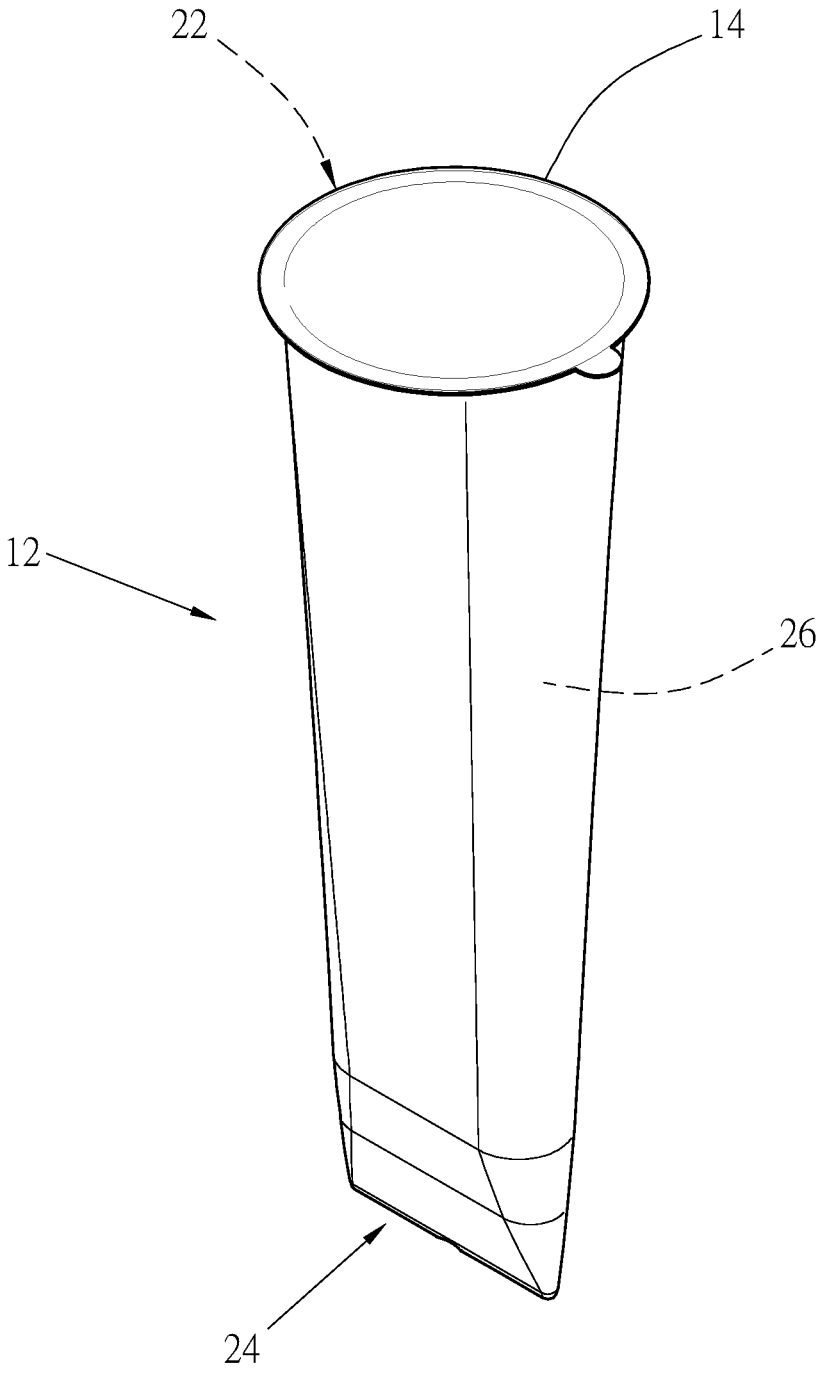
FIG. 6 is a schematic perspective view of the present invention with a lid.

Referring to FIG. 6, the hollow hand-held storage device for storing items of the present invention further includes a lid 14. The lid 14 may be formed by an aluminum foil coated with a PE film layer and heat-sealed to the first end 22, thereby effectively preventing outside air from entering the chamber 26 of the hollow body 12 through the first end 22.

Figure 7:
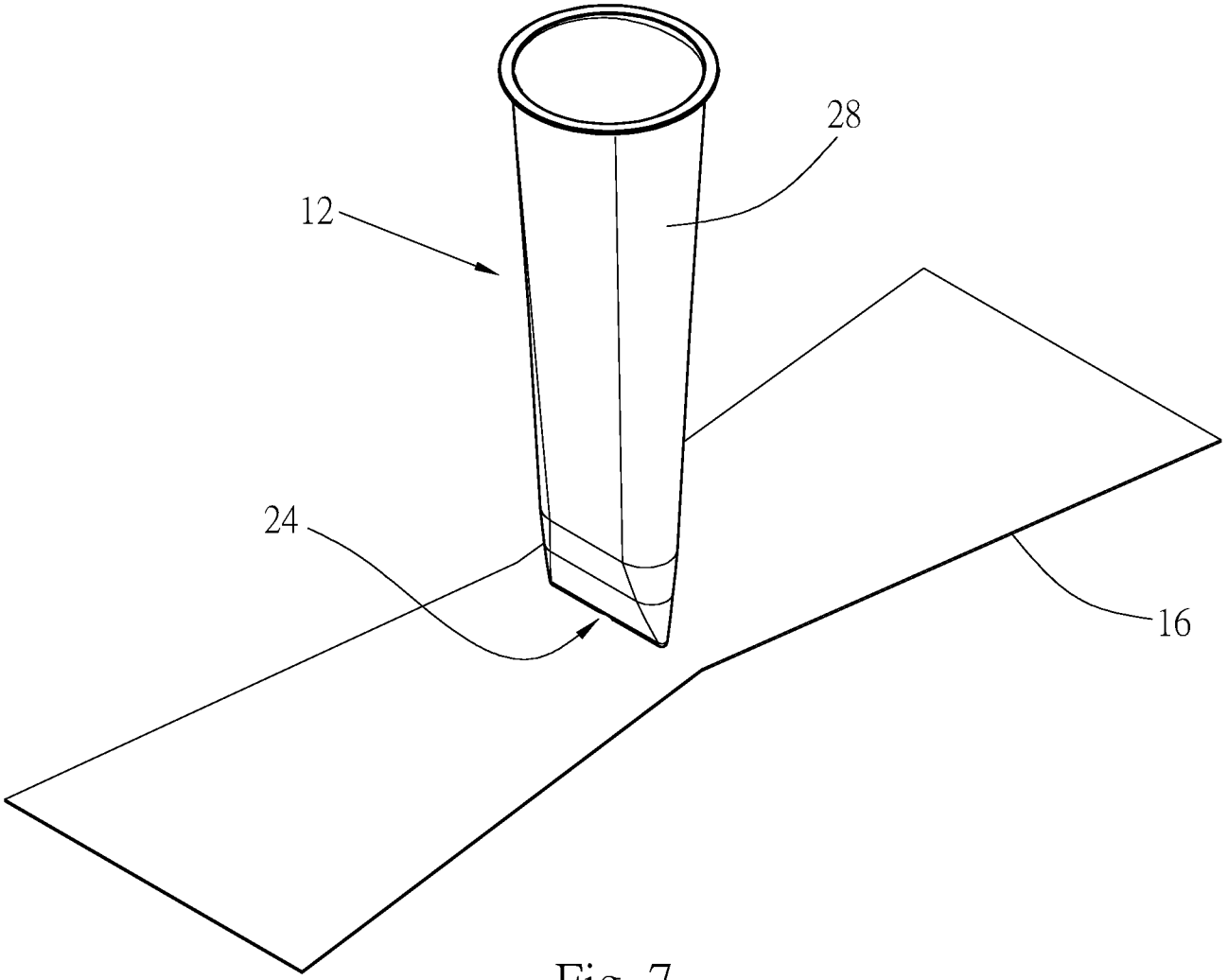
FIGS. 7 to 9 are schematic views illustrating the process of assembling an outer layer of the present invention.
Figure 9:
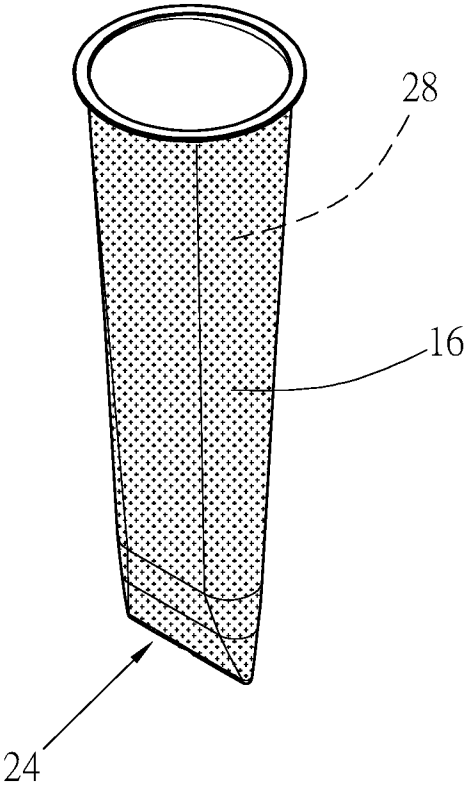
Figure 8:
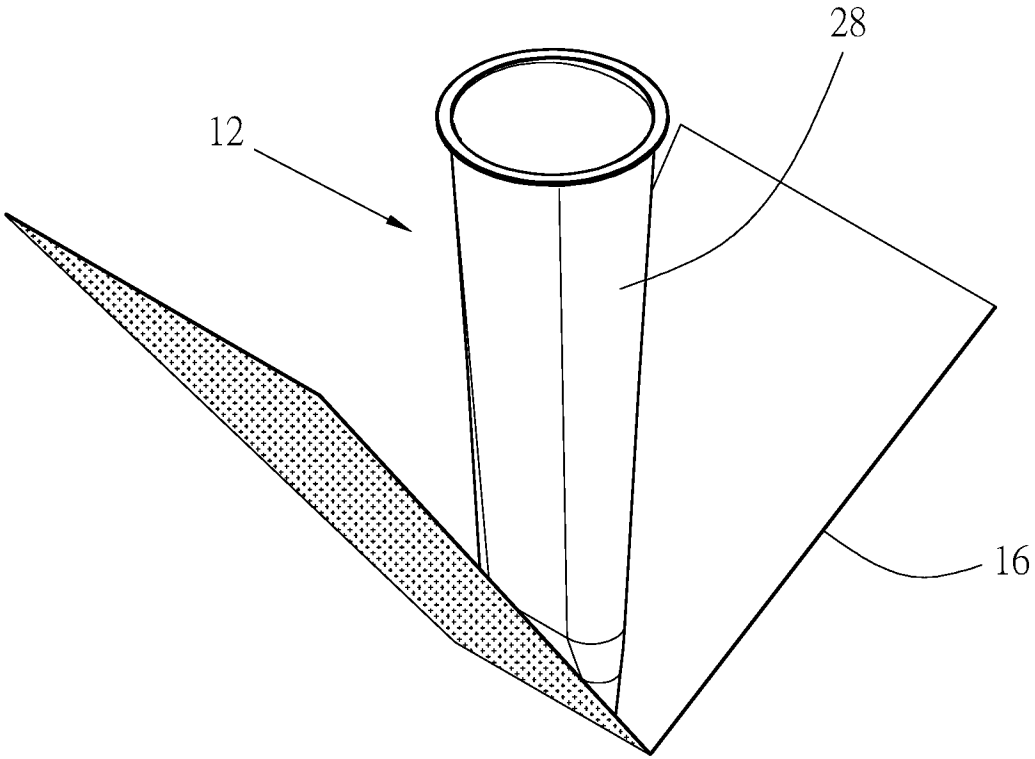

Referring to FIGS. 7 to 9, the hollow hand-held storage device for storing items of the present invention further includes an outer layer 16. The outer layer 16 is a thin sheet-like film, and is adhered or heat-sealed to the outer wall surface 28 of the hollow body 12 by a central portion of the outer layer 16 corresponding to the second end 24 of the hollow body 12 to further enhance the effect of isolating outside air. A outer surface of the outer layer 16 may further be printed or adhered with different patterns, descriptions or markings to accommodate different contents, and a material of the outer layer 16 may be PP plastic.

Figure 10:
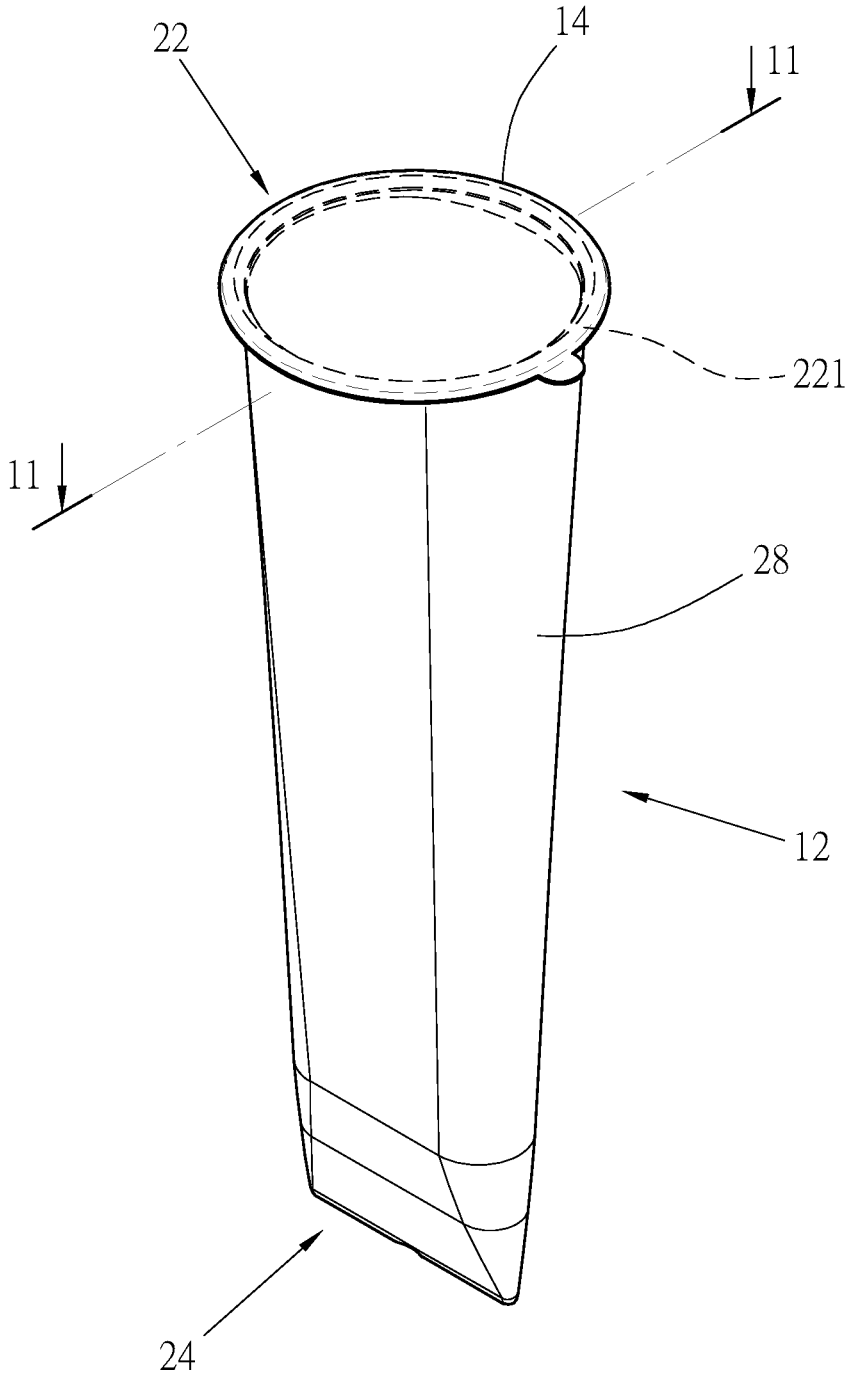
FIG. 10 is a schematic perspective view of another embodiment of the present invention with a lid.
Figure 11:
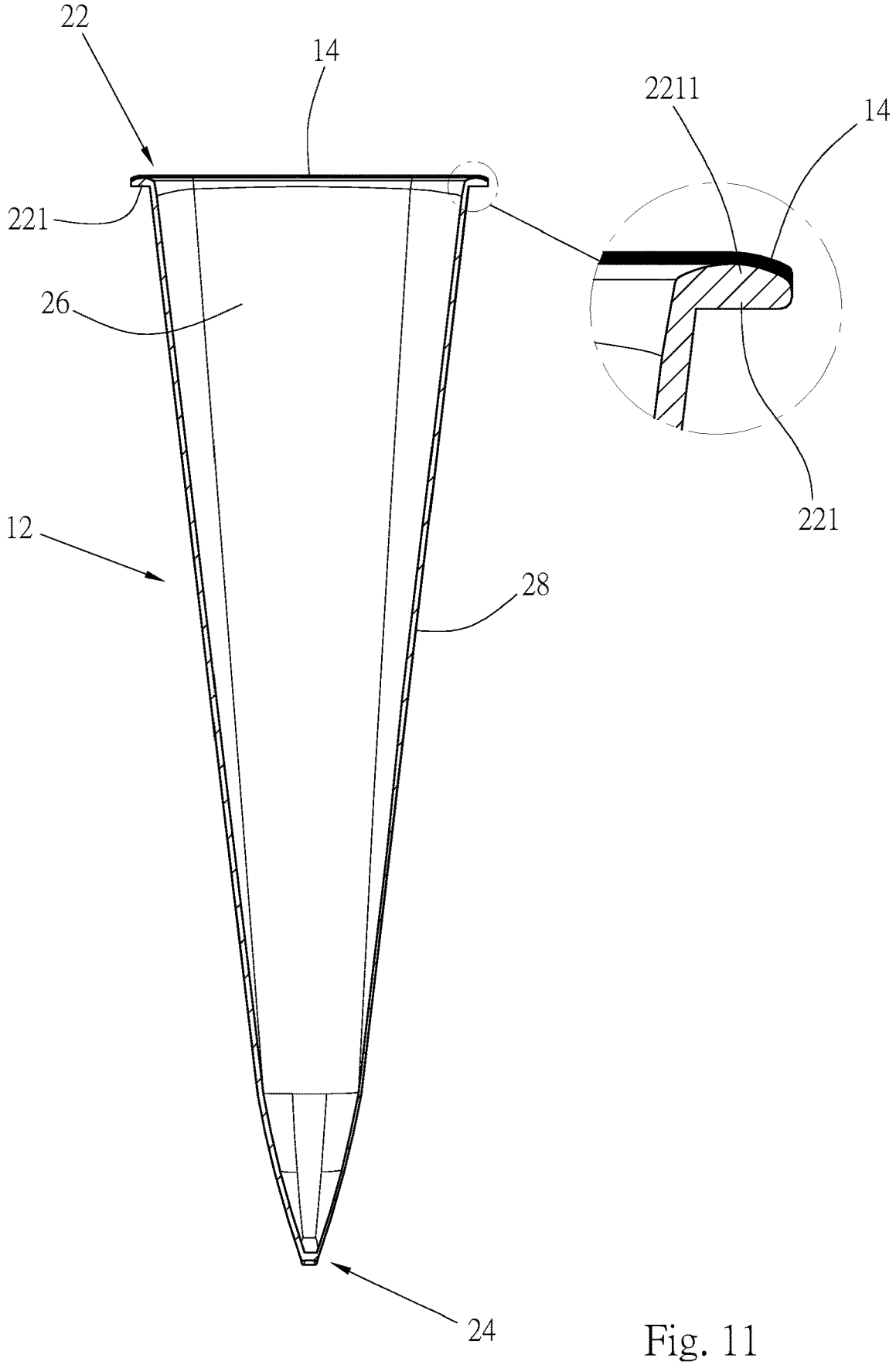
FIG. 11 is a sectional view taken along line 11-11 in FIG. 10.

Referring to FIGS. 10 and 11, in the hollow hand-held storage device for storing items of the present invention, the first end 22 extends outwardly in the transverse direction to form an annular rim 221 with an appropriate width around its periphery, which increases the bonding area between the lid 14 and the first end 22 for better bonding efficiency. The central portion of the annular rim 221 is further provided with an annular protrusion 2211, so that when the lid 14 is heat-sealed to the first end 22, the annular protrusion 2211 provides better contact and heat transfer efficiency, thereby improving the heat-sealing effect.

In the hollow hand-held storage device for storing items of the present invention, since the hollow body 12 is formed by fusion bonding of plastics such as PP plastic or PE plastic, after squeezing the hollow body 12, the hollow body 12 can recover its original shape when not subjected to force, allowing any semi-solid contents adhered to/remaining at the first end 22 to be drawn in.

What is claimed is:

1. A hollow hand-held storage device for storing items, comprising at least:

a hollow body formed by fusion bonding of plastic pellets to form a cylindrical body having a chamber, wherein a cross-section of a central portion of the hollow body is defined as a central plane;

a first end being an opening located at one end of the hollow body and communicating with the chamber; and a second end being a closed end located at the other end of the hollow body;

wherein a portion of the hollow body between the first end and the central plane is defined as an upper body, a portion of the hollow body between the second end and the central plane is defined as a lower body, and the cylindrical body has different thicknesses, being selected from a group consisting of the thickness of the cylindrical body in the upper body being greater than the thickness in the lower body, and the corresponding two side surfaces of the cylindrical body in the lower body having different thicknesses, so that when the central portion or the lower body of the hollow body receives a gripping force, a deformation of the hollow body is selected from a group consisting of the deformation of the lower body being greater than the deformation of the upper body, and the two side surfaces of the lower body having different deformations.

2. The storage device according to claim 1, further comprising an outer layer, the outer layer being a sheet body, and being attached to an outer wall surface of the hollow body by a central portion of the outer layer corresponding to the second end of the hollow body.

3. The storage device according to claim 1, wherein a cross-sectional area gradually decreases from the first end toward the second end.

4. The storage device according to claim 2, wherein a cross-sectional area gradually decreases from the first end toward the second end.

5. The storage device according to claim 1, further comprising a lid, the lid being formed by an aluminum foil coated with a PE film layer and heat-sealed to the first end.

6. The storage device according to claim 2, further comprising a lid, the lid being formed by an aluminum foil coated with a PE film layer and heat-sealed to the first end.

7. The storage device according to claim 5, wherein the first end extends outwardly in transverse direction to form an annular rim with an appropriate width around its periphery.

8. The storage device according to claim 6, wherein the first end extends outwardly in transverse direction to form an annular rim with an appropriate width around its periphery.

9. The storage device according to claim 7, wherein a central portion of the annular rim has an annular protrusion.

10. The storage device according to claim 8, wherein a central portion of the annular rim has an annular protrusion.

* * * * *